US010458095B2

(12) United States Patent
Caillieret et al.

(10) Patent No.: US 10,458,095 B2
(45) Date of Patent: Oct. 29, 2019

(54) CONTROL METHOD FOR CONTROLLING AN EXCAVATOR AND EXCAVATOR COMPRISING A CONTROL UNIT IMPLEMENTING SUCH A CONTROL METHOD

(71) Applicant: VOLVO CONSTRUCTION EQUIPMENT AB, Eskilstuna (SE)

(72) Inventors: Roger Caillieret, Brens (FR); François Savoye, Miribel (FR); Ahcéne Nedjimi, Lyons (FR); Lilian Bruyere, Belley (FR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 145 days.

(21) Appl. No.: 15/540,066

(22) PCT Filed: Jan. 7, 2015

(86) PCT No.: PCT/IB2015/000324

§ 371 (c)(1),
(2) Date: Jun. 27, 2017

(87) PCT Pub. No.: WO2016/110726

PCT Pub. Date: Jul. 14, 2016

(65) Prior Publication Data

US 2017/0356157 A1 Dec. 14, 2017

(51) Int. Cl.

| | |
|---|---|
| ***E02F 3/43*** | (2006.01) |
| ***E02F 3/42*** | (2006.01) |
| ***E02F 9/20*** | (2006.01) |

(52) U.S. Cl.

CPC ..... *E02F 3/43* (2013.01); *E02F 3/42* (2013.01); *E02F 9/2079* (2013.01); *E02F 9/2083* (2013.01); *E02F 9/2095* (2013.01)

(58) Field of Classification Search

CPC ... E02F 3/42; E02F 3/43; E02F 9/2079; E02F 9/2083; E02F 9/2095

See application file for complete search history.

(56) References Cited

U.S. PATENT DOCUMENTS 5,308,219 A * 5/1994 Lee ..... E02F 3/435 414/695.5
5,913,811 A * 6/1999 Kinugawa ..... E02F 9/207 60/420

(Continued)

FOREIGN PATENT DOCUMENTS

| | | | | |
|---|---|---|---|---|
| EP | 1126086 | A1 | 8/2001 | |
| WO | 2013114451 | A1 | 8/2013 | |
| WO | WO-2013114451 | A1 * | 8/2013 | ..... E02F 3/425 |

OTHER PUBLICATIONS

International Search Report (dated Aug. 27, 2015) for corresponding International App. PCT/IB2015/000324.

*Primary Examiner* — Babar Sarwar
(74) *Attorney, Agent, or Firm* — Sage Patent Group

(57) ABSTRACT

A control method includes the steps of: providing an excavator including: several movable members configured to move parts of the excavator, one actuating set comprising several actuators, among which at least one electric actuator, one or more static brakes movable between: i) a locking position and ii) an unlocking position, a command device to receive commands from an operator, a control unit to control the actuators and the static brakes based on command signals. The control method further includes: a reception step for receiving a command signal, an actuation check step to check whether the command signal requires the control unit to actuate an actuator of the actuating set, and if yes, an unlocking step wherein the control unit releases the static brakes of the actuating set.

30 Claims, 2 Drawing Sheets

(56) References Cited

U.S. PATENT DOCUMENTS 6,635,973 B1 * 10/2003 Kagoshima ..... E02F 9/2075 307/10.1
8,716,973 B1 * 5/2014 Lammertse ..... G06F 3/016 318/560
8,994,519 B1 * 3/2015 Fuchs ..... G01C 21/3407 299/67
2003/0089106 A1 * 5/2003 Ioku ..... E02F 9/2239 60/328
2003/0132729 A1 * 7/2003 Yoshimatsu ..... E02F 9/2075 320/104
2004/0148817 A1 * 8/2004 Kagoshima ..... B60K 6/12 37/348
2005/0022850 A1 * 2/2005 Jones ..... B08B 7/0021 134/58 R
2005/0253542 A1 * 11/2005 Sugano ..... E02F 9/128 318/371
2006/0124323 A1 * 6/2006 Glover ..... E02F 9/26 172/2
2006/0218912 A1 * 10/2006 Price ..... E02F 9/2025 60/459
2007/0214782 A1 * 9/2007 Komiyama ..... B60K 6/46 60/431
2008/0087163 A1 * 4/2008 Brickner ..... E02F 3/432 91/369.2
2008/0160246 A1 * 7/2008 Buhler ..... H01L 23/3735 428/99
2009/0127031 A1 * 5/2009 Corder ..... G01G 19/10 187/393
2010/0124453 A1 * 5/2010 Sikorski ..... E02F 3/3618 403/19
2010/0170227 A1 * 7/2010 Tsukada ..... E02F 9/00 60/286
2010/0201180 A1 * 8/2010 Maynard ..... E21C 41/18 299/18
2010/0280697 A1 * 11/2010 Yanagisawa ..... B60W 20/10 701/22
2012/0024189 A1 * 2/2012 Wickman ..... B60F 1/043 105/72.2
2012/0240582 A1 * 9/2012 Ooki ..... E02F 9/123 60/711
2012/0245760 A1 * 9/2012 Ikeya ..... B60R 1/00 701/1
2013/0152573 A1 * 6/2013 Tsuruga ..... E02F 9/2075 60/420
2013/0197766 A1 * 8/2013 Kurikuma ..... E02F 3/325 701/50
2013/0318956 A1 * 12/2013 Yunoue ..... E02F 9/207 60/420
2013/0325235 A1 * 12/2013 Kurikuma ..... E02F 9/207 701/22
2014/0046552 A1 * 2/2014 Tsuruga ..... E02F 9/2091 701/50
2014/0052350 A1 * 2/2014 Tsuruga ..... E02F 3/325 701/50
2014/0083089 A1 * 3/2014 Wutke ..... F15B 15/18 60/327
2014/0184122 A1 * 7/2014 Ogawa ..... E02F 9/2095 318/461
2014/0205412 A1 * 7/2014 Bienfang ..... E02F 3/425 414/697
2014/0303862 A1 * 10/2014 Hoff ..... B60W 10/12 701/67
2014/0325972 A1 * 11/2014 Ma ..... E02F 9/2217 60/327
2014/0371995 A1 * 12/2014 Udagawa ..... E02F 9/123 701/50
2015/0284933 A1 * 10/2015 Shin ..... F15B 15/18 60/484
2015/0337521 A1 * 11/2015 Sakamoto ..... B60K 6/485 180/65.26
2016/0089283 A1 * 3/2016 DeLuca ..... A61G 1/0243 180/413
2016/0145832 A1 * 5/2016 Stockhaus ..... E02F 3/3677 414/694
2016/0265196 A1 * 9/2016 Shimizu ..... B60K 35/00
2017/0356157 A1 * 12/2017 Caillieret ..... E02F 3/42

* cited by examiner

CONTROL METHOD FOR CONTROLLING AN EXCAVATOR AND EXCAVATOR COMPRISING A CONTROL UNIT IMPLEMENTING SUCH A CONTROL METHOD

BACKGROUND AND SUMMARY

The present invention relates to a control method for controlling an excavator. Besides, the present invention relates to an excavator comprising a control unit implementing such a control method.

The invention can be applied in construction equipment machines, such as mechanical shovels or drillers and any other type of excavator. Such excavator may be a tracked swilling excavator comprising either a caterpillar track or wheels, and a cantilever member coupled to a rotating platform mounted on the caterpillar track.

The invention can also be applied to wheeled excavators and or to backhoe loaders. Although the invention will be described with respect to a mechanical shovel, the invention is not restricted to this particular construction equipment, but may also be used in other construction equipment machines.

W013114451A1 discloses an excavator including several movable members and several electric actuators to actuate said movable members, several static brakes to lock said electric actuators, a command device to receive commands from an operator and a control unit to control said electric actuators and said static brakes.

Each electric actuator usually comprises a rotational electric motor which can rotate in either way (reversible). The static brakes maintain the electric actuator in an idle, static position over long periods, so that the electric actuators can hold the loads or torques without consuming electric power. A static brake can for instance be formed by a gear lock.

When the operator handles the command device in order to command a motion of a movable member, the control unit releases a first static brake so as to move the corresponding electric actuator. Then, the control unit often needs to release a second static brake so as to move another electric actuator, in particular when the required motion commands a large motion amplitude. The control unit can successively release several static brakes until the required motion is complete.

However, when the second static brake is released while the first one is moving, there is a risk of backlash or small bump, which decreases the operator's comfort and may reduce the service life of some components of the excavator.

It therefore appears that, from several standpoints, there is room for improvement in the control methods for controlling an excavator and in the excavator including a control unit implementing such a control method.

It is desirable to provide a control method which reduces or avoids the risk of backlash when several electric actuators have to work simultaneously or concomitantly.

According to one aspect of the invention, a control method, for controlling an excavator, includes a step of:

providing an excavator including at least:

several movable members, each movable member being configured to move at least a part of said excavator, at least one actuating set comprising at least two actuators, said at least two actuators including at least one electric actuator, each actuator being configured to actuate at least one of said movable members, at least one static brake movable between a locking position where said at least one static brake locks said at least one electric actuator and an unlocking position where said at least one static brake unlocks said at least one electric actuator, a command device configured to receive commands from an operator and to generate command signals based on said commands, a control unit configured to receive said command signals and to control said actuators and said at least one static brake based on said command signals.

Furthermore, this control method includes at least:

a reception step wherein said control unit receives a command signal, an actuation check step wherein said control unit checks whether said command signal requires said control unit to actuate at least one actuator belonging to said at least one actuating set, and in case said command signal requires said control unit to actuate an actuator belonging to said at least one actuating set, an unlocking step wherein said control unit controls said at least one static brake so that said at least one static brake moves towards its unlocking position.

Thus, such a control method allows the excavator to generate smooth motions with small or null backlash in case two or more movable members need be moved concomitantly. By the provision of such an excavator arm, one advantage of such a control method is the reduction of the risk of backlash when several electric actuators have to work simultaneously or concomitantly, as compared to the excavator of W013114451A1. Indeed, during the unlocking step, the control unit causes the unlocking of the or each electric actuator belonging to the or each actuating set.

According to a variant, said at least one actuating set may comprise at least one hydraulic actuator. For instance, said at least one actuating set may comprise one hydraulic actuator and one electric actuator. Thus, when the operator sends a command which requires the control unit to first operate the hydraulic actuator, the control unit unlocks the static brake from locking the electric actuator during the unlocking step. Releasing the or each electric actuator allows a smooth motion (hence with little or no backlash) when the movable member gets afterwards actuated by the operator of the excavator.

According to an embodiment, said control unit can control said at least one static brake so that said at least one static brake moves towards its unlocking position within less than 500 milliseconds, preferably within less than 100 milliseconds.

Thus, unlocking the or each static brake is so quick that the operator of the excavator can hardly, if ever, feel any backlash.

According to an embodiment, said at least one actuating set may comprise at least two electric actuators; said excavator includes at least two static brakes, each static brake being movable between: i) a respective locking position where said static brake locks a respective electric actuator, and ii) a respective unlocking position where said static brake unlocks said respective electric actuator; and, during said unlocking step, said control unit controls each static brake so that each static brake moves towards its respective unlocking position.

Thus, such an actuating set provides for smooth motions upon successive actuating of the electric actuators belonging to the actuating set.

According to a variant of the previous embodiment, said at least one actuating set may comprise only electric actuators. In other words, said at least one actuating set does not comprise any other kind of actuator, in particular no hydraulic actuator, apart from electric actuators. During the unlocking step, the control unit controls each static brake so that each static brake moves towards its respective unlocking position. Such an all-electric actuating set makes it possible to get rid of all the components required for hydraulic actuators, like fluid hoses, pumps and the like.

According to an embodiment, said actuators belonging to said at least one actuating set can be configured to cooperate in order to generate a combined motion of at least one of said movable members.

Thus, such a control method allows the excavator to generate smooth combined motions with small or null backlash when two adjacent movable members are moved either successively or concomitantly.

According to an embodiment, the control method further includes an actuation step wherein said control unit actuates at least two actuators belonging to said at least one actuating set when said command signal requires said control unit to actuate said at least two actuators belonging to said at least one actuating set.

Thus, such actuation step allows the excavator to generate smooth motions with small or null backlash when two movable members are moved concomitantly.

According to an embodiment, said at least one electric actuator can be selected in the group consisting of a linear electric actuator and a rotational electric actuator.

According to a variant, said at least one electric actuator can comprise a reversible mechanical linear actuator. For instance each of said electric linear actuators can comprise a ball screw, a roller screw or a buttress thread screw, the screw imparting translation to a linear actuator rod by a nut. Alternatively, said arm linear actuator can comprise an irreversible mechanical linear actuator.

According to a variant, said at least one electric actuator can comprise an electric motor, an actuating device and a gearbox configured to transmit power from said electric motor to said actuating device.

According to an embodiment, said at least one electric actuator can include a respective electric motor, and wherein, during said unlocking step, said control unit energizes said electric motor.

Thus, the electric motor can remain idle until unlocking step begins, which permits to reduce electric power consumption. Once their electric motors get energized, the electric actuators can hold the load in lieu of the static brakes.

According to an embodiment, during said unlocking step, said control unit can energize said electric motor before said at least one static brake moves towards its respective unlocking position.

Thus, such an unlocking step allows the excavator to generate smooth motions with a small or null backlash.

According to an embodiment, during said unlocking step, said control unit can energize said electric motor substantially during a period where said at least one static brake moves towards its respective unlocking position.

Thus, the excavator can be operated swiftly, because the electric actuators are already fully energized as soon as each static brake has finished unlocking each electric actuator.

According to an embodiment, during said unlocking step, said control unit can energize said electric motor of said at least one electric actuator progressively as said at least one static brake moves towards its respective unlocking position.

Thus, such a progressive energizing of each electric motor allows the excavator to generate smooth motions with a small or null backlash.

According to an embodiment, during said unlocking step, said control unit can energize said at least one electric motor so as to actuate said at least one electric actuator belonging to said at least one actuating set.

Thus, the or each electric actuator actuated moves its respective movable member.

According to an embodiment, during said unlocking step, said control unit can energize at least one electric motor so as to maintain in a static position said at least one electric actuator.

Thus, the or each electric actuator maintained static holds immobile its respective movable member.

According to an embodiment, during said unlocking step, said control unit energizes both:

at least one electric motor so as to actuate at least one of said electric actuators belonging to said at least one actuating set, and the remaining electric motors of all of said electric actuators belonging to said at least one actuating set in order to maintain in a static position said electric actuators.

According to an embodiment, during said unlocking step, said control unit can energize all the electric motors so as to actuate all of said electric actuators belonging to said at least one actuating set.

According to an embodiment, said control unit can comprise a memory for storing at least a dataset containing data identifying each actuator belonging to said at least one actuating set.

Thus, such a memory permits to define the actuating sets prior to using the excavator, for instance depending upon the combined motions which will most likely be commanded by the operator.

According to an embodiment, said excavator can further comprise a cab, and each one of said movable members can be selected from the group consisting of a tool configured to work on a site, an arm configured to move said tool, a boom configured to move said arm, an offset member configured to offset said boom, a drive member configured to displace said cab with respect to a site ground and a blade configured to partially lift said cab.

Thus, such movable members permit to define an excavator having an extended reach and several possible motions.

According to an embodiment, said movable members can include a tool configured to work on a site and an arm configured to move said tool, wherein said at least one actuating set can comprise a tool actuating set, said tool actuating set including at least a tool actuator configured to drive said tool and an arm actuator configured to drive said arm, and wherein said at least one static brake can include at least a tool static brake configured to lock said tool actuator and an arm static brake configured to lock said arm actuator.

Thus, such a tool actuating set allows the excavator to generate smooth combined motions with small or null backlash when the tool and the arm are moved concomitantly.

The tool can be any kind of tool usually implemented on mechanical construction equipment. For instance, the tool can be selected from the group consisting of a bucket, a drilling tool, a hammer and a gripping tool.

Such tools can be linked to the arm via an appropriate link configured to provide a quick coupling, be it hydraulic, electric and/or mechanic, between the arm and the tool. Usually, the tool is mounted at the tip of the arm.

According to an embodiment, said movable members can further include a boom configured to move said arm, wherein said tool actuating set can further include a boom actuator configured to drive said boom, and wherein said static brakes can further include a boom static brake configured to lock said boom actuator.

Thus, such a tool actuating set allows the excavator to generate smooth combined motions with small or null backlash when the tool, the arm and the boom are moved concomitantly.

According to an embodiment, said movable members can further include an offset member configured to offset said boom, and wherein said tool actuating set can further include an offset actuator configured to drive said offset member, and wherein said static brakes can further include an offset static brake configured to lock said offset actuator.

According to an embodiment, said excavator can further comprise a cab, and said movable members can include a blade configured to partially lift said cab, and a drive member configured to displace said cab, wherein said at least one actuating set can comprise a cab actuating set, said cab actuating set including at least a blade actuator configured to drive said blade, and a drive actuator configured to drive said drive member, and wherein said at least one static brake can include at least a blade static brake configured to lock said blade actuator, and a drive static brake configured to lock said drive member.

Thus, such a cab actuating set allows the excavator to generate smooth combined motions with small or null backlash when the blade and the drive member are moved concomitantly.

According to an embodiment, said drive member can comprise at least two drive devices including a right track drive device configured to impart a translation to a right part of said excavator and a left track drive device configured to impart a translation to a left part of said excavator, and wherein said cab actuating set can be configured to actuate both said right track drive device and said left track drive device.

According to an embodiment, said movable members can further include a swing member configured to swing said cab, wherein said cab actuating set can further include at least a swing actuator configured to drive said swing member, and wherein said static brakes can include at least a swing static brake configured to lock said swing actuator.

According to a variant, said excavator can include at least two actuating sets. One or more actuator can be shared by said at least two actuating sets. Alternatively, each actuator can be dedicated to only one actuating set.

According to a variant, said excavator can include both a tool actuating set and a cab actuating set.

According to a variant, said cab actuating set can further comprise: said drive member, possibly including said right track drive device and said left track drive device, said swing actuator, and/or a blade actuator configured to actuate a blade for immobilizing said excavator with respect to the site ground.

According to a variant, said at least one actuating set can include a large actuating set configured to drive numerous electric actuators. Such a large actuating set would thus form a superset. For instance, said large actuating set can comprise the electric actuators configured to actuate said blade, said swing member, said drive member, possibly including said right track drive device and said left track drive device.

In case the blade actuator is activated, then automatically the drive member (right and left track drive devices) are unlocked. However, in case one of right and left track drive devices is activated, the other one of left and right track drive devices can be activated, while the blade actuator remains unactivated.

According to an embodiment, the control method can further include a lock check step wherein said control unit checks whether said at least one electric actuator is currently locked, wherein said control unit can perform said unlocking step in case said at least one electric actuator belonging to said at least one actuating set is currently locked.

In such an embodiment, both said actuation check step and said lock check step trigger the unlocking step. Said lock check step can occur before, after or during said actuation check step occurs. Thus, such a lock check step allows the control unit to release the static brakes only when they are currently locked. To check whether the or each electric actuator belonging to an actuating set are currently locked, the control unit checks whether the corresponding static brake is in its locking position or in its unlocking position.

According to an embodiment, said excavator can further include several position sensors, each position sensor being configured to detect the position of a respective electric actuator and to send position signals to said control unit, said control unit being further configured to determine the position of each one of said electric actuators based upon said position signals.

Throughout the present application, the term "position sensor" defines a device configured to electronically monitor the position or movement of a component, for instance of a movable member. A position sensor generally produces an electrical signal that varies as the position of said component varies.

Thus, such position sensors allow the control unit to monitor the positions of the electric actuators.

According to an embodiment, each position sensor can be an encoder coupled with an electric actuator.

According to an embodiment, said control unit can further comprise at least one timer for counting at least one predetermined period as from the start of said reception step, and wherein, after said predetermined period has elapsed without said control unit receiving any further command signal, said control unit can control said at least one static brake so as to move said at least one static brake towards its respective locking position.

Thus, in case the operator stops sending command signals to the control unit, such a timer permits to spare electric power, as it enables the control unit to lock again the static brakes instead of keeping energized the electric motors of the electric actuators belonging to the actuating set(s).

According to a variant, said excavator can comprise several actuating sets, and said control unit comprises at least one timer per actuating set.

According to an embodiment, said excavator can further comprise at least one temperature sensor configured to measure the temperature of said at least one electric actuator and connected to said control unit, said control method can further include a cooling step wherein, in case said temperature exceeds a predetermined temperature threshold, said control unit can control said at least one static brake so as to move said at least one static brake towards its respective locking position.

According to a variant, said at least one actuating set can comprise at least one hydraulic actuator, said excavator can comprise at least one hydraulic static lock configured to lock said at least one hydraulic actuator, and said control unit can further be configured to control said at least one hydraulic actuator and said at least one hydraulic static lock.

According to a variant, said excavator can comprise at least one hydraulic actuation set comprising only hydraulic actuators and no electric actuator, said excavator further comprising hydraulic static lock configured to lock said hydraulic actuators.

Possibly, an operator may temporarily switch off or deactivate said control method, for instance via a button or a via human machine interface.

According to another aspect of the invention, an excavator includes at least:

several movable members, each movable member being configured to move at least a part of said excavator, at least one actuating set comprising at least two actuators, said at least two actuators including at least one electric actuator configured to actuate at least one of said movable members, at least one static brake movable between: i) a locking position where said at least one static brake locks said at least one electric actuator, and ii) an unlocking position where said at least one static brake unlocks said at least one electric actuator, a command device configured to receive commands from an operator and to generate command signals based on said commands, a control unit configured to receive said command signals and to control said actuators and said at least one static brake based on said command signals, said control unit being further configured to perform at least:

a reception step wherein said control unit receives a command signal, an actuation check step wherein said control unit checks whether said command signal requires said control unit to actuate an actuator belonging to said at least one actuating set, and in case said command signal requires said control unit to actuate an actuator belonging to said at least one actuating set, an unlocking step wherein said control unit controls said at least one static brake so that said at least one static brake moves towards its unlocking position.

Thus, such a control method allows the excavator to generate smooth motions with small or null backlash in case two or more movable members need be moved simultaneously or concomitantly.

According to a variant, the excavator further includes a switching device configured to switch the operation of said control unit between a inactive mode where said control unit temporarily operates without performing said reception step, said actuation step and said unlocking step, and an active mode where said control unit performs said reception step, said actuation step and said unlocking step.

Thus, an operator may temporarily switch off or deactivate said control method, for instance via a button or a via human machine interface.

Within the scope of the present invention, the aforementioned embodiments and variants can be considered either in isolation or in any technically possible combination.

BRIEF DESCRIPTION OF THE DRAWINGS

The features and advantages of the present invention will also appear upon reading the following description in view of the appended drawings, which represent, as non-limiting examples, an embodiment of an excavator arm according to the invention.

The following detailed description of several embodiments of the invention is better understood when read in conjunction with the appended drawings. However, the invention is not limited to the specific embodiments disclosed herewith.

DETAILED DESCRIPTION

Figure 1:
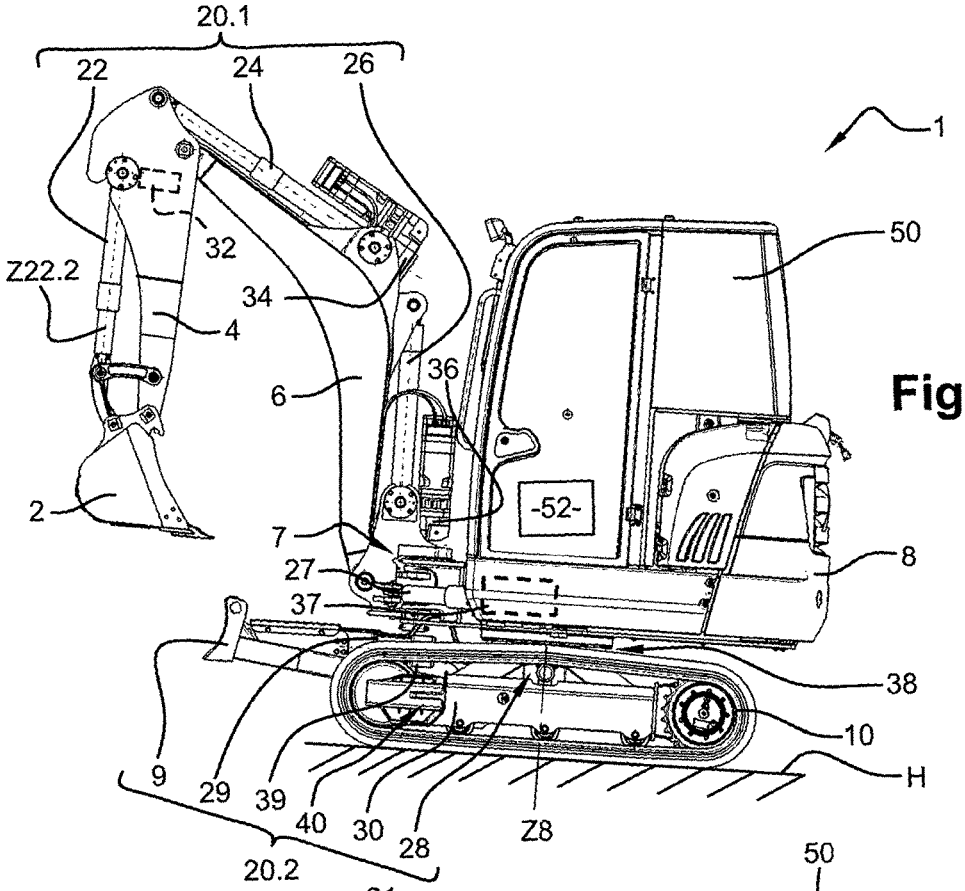
FIG. 1 is a schematic side view of an excavator according to one aspect of the invention.

FIG. 1 illustrates an excavator 1 according to one aspect of the invention. In the example of FIG. 1, excavator 1 is a mechanical shovel. Excavator 1 includes a cab 50, for accommodating an operator, and several movable members, in particular:

a tool 2 configured to work on a site, an arm 4 configured to move tool 2, a boom 6 configured to move arm 4, an offset member 7 configured to offset boom 6, so as to rotate boom 6 substantially about a vertical axis, a swing member 8 configured to swing cab 50, a drive member 10 configured to displace swing member 8 with respect to a site ground, and a blade 9 configured to partially lift cab 50 and drive member 10, in order to immobilize cab 50 while excavator 1 is excavating the ground.

Each movable member 2, 4, 6, 8, 10 is configured to bear and move a respective part of excavator 1. When excavator 1 is in service, tool 2 moves itself, arm 4 moves tool 2, boom 6 moves arm 4, swing member 8 moves boom 6 and drive member 10 moves swing member 8. Drive member 10 can include a right track drive device 10.1 and a left track drive device 10.2, as visible on FIG. 2.

Tool 2 and arm 4 can be linked by an articulation, e.g. a hinge, which allows at least a rotation of tool 2 relative to arm 4. Arm 4 and boom 6 can be linked by an articulation, e.g. a hinge, which allows at least a rotation of arm 4 relative to boom 6. Boom 6 and offset member 7 can be linked by an articulation, e.g. a hinge, which allows at least a rotation of boom 6 relative to offset member 7. Swing member 8 and drive member 10 can be linked by an articulation, e.g. a hinge, which allows at least a rotation of swing member 8 relative to drive member 10. Swing member 8 is configured to swing cab 50 about a swing axis Z8 which is substantially vertical when excavator 1 lies on a horizontal site H.

For the movable member 2, 4, 6, 8, 10 to move a respective part of excavator 1, excavator 1 further includes several actuating sets, each actuating set comprising at least two electric actuators configured to actuate at least one of the movable members 2, 4, 6, 8, 10.

The actuating sets can comprise a tool actuating set 20.1, which herein includes:

a tool actuator 22 configured to drive tool 2, an arm actuator 24 configured to drive arm 4, a boom actuator 26 configured to drive said boom 6, and an offset actuator 27 configured to drive said offset member 7.

The electric actuators 22, 24, 26 and 27 belonging to the tool actuating set 20.1 can be configured to cooperate in order to generate a combined motion of an assembly formed by tool 2, arm 4, boom 6 and offset member 7.

The tool actuator 22 can have two telescopic parts which are mounted in a telescopic arrangement and which may be displaced lengthwise by a non illustrated electric motor so as to vary the length of tool actuator 22. A mechanism links the two telescopic parts of the tool actuator 22 in order to convert a rotary motion of the electric motor in a linear relative displacement of the two telescopic parts. Such a mechanism can be of the roller screw type.

Likewise, the arm actuator 24 and boom actuator can have telescopic parts displaceable by means of a rotational electric motor and of a roller screw.

The actuating sets can further comprise a cab actuating set 20.2, which herein includes:

a swing actuator 28 configured to drive said swing member 8, a blade actuator 29 configured to drive said blade 9, and a drive actuator 30 configured to drive said drive member 10.

Swing member 8 can comprise a rotating platform bearing cab 50.

Figure 2:
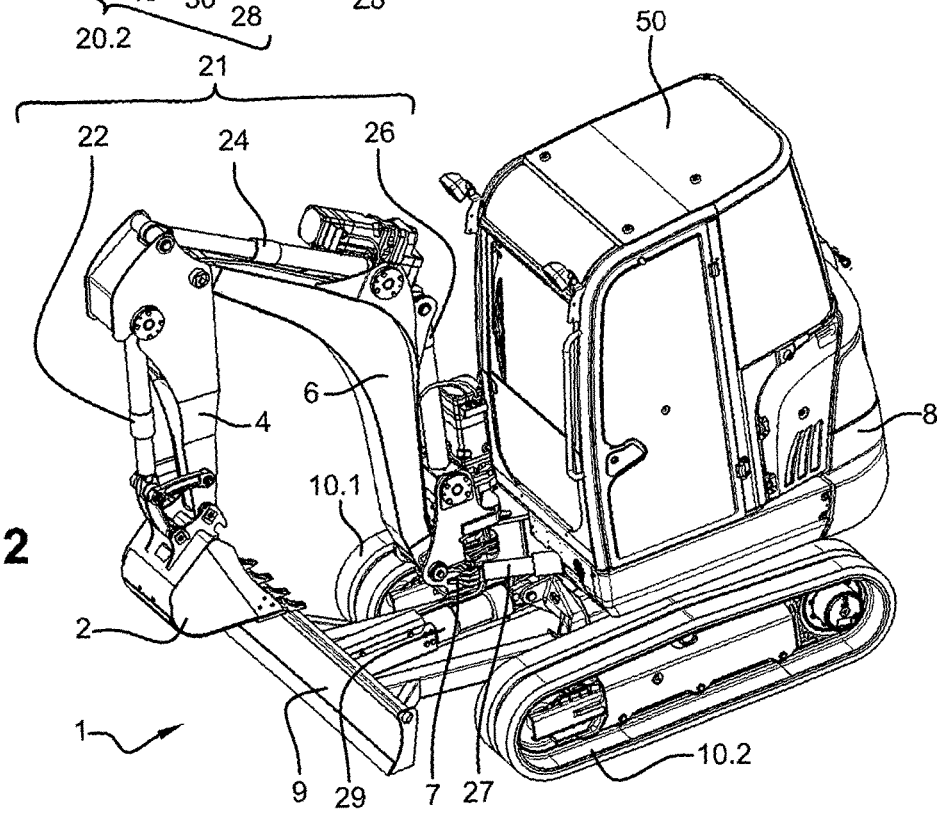
FIG. 2 is a schematic perspective view of the excavator of FIG. 1.

Blade 9 comprises a main blade and two legs which are articulated to a substructure of cab 50, as visible on FIG. 2. Drive member 10 can comprise either a caterpillar track or wheels for driving excavator 1.

The actuators 28, 29 and 30 belonging to the cab actuating set 20.2 can be configured to cooperate in order to generate a combined motion of an assembly formed by swing member 8 and drive member 10.

The electric actuators can be formed by linear electric actuators. The electric actuators include respective electric motors. Electric power can be supplied to the electric motors by a non illustrated electric accumulator which can for instance be mounted on a chassis of excavator 1. The electric accumulator can store 15 kWh of energy and supply current at a 600 V tension. A DC/DC converter can supply each electric motor with current at a suitable tension. Electric motors in turn supply mechanical power to the electric actuator.

Excavator 1 further includes several static brakes, each static brake is movable between: i) a non illustrated locking position where the static brake locks one electric actuator, and ii) a non illustrated unlocking position where the static brake unlocks the electric actuator. In other words, each static brake is configured to lock one of the electric actuators 22, 24, 26, 27, 28, 29, 30.

The static brakes can include a tool static brake 32 configured to lock tool actuator 22, an arm static brake 34 configured to lock arm actuator 24, a boom static brake 36 configured to lock boom actuator 26 and an offset static brake 37 configured to lock offset actuator 27.

Tool static brake 32 is movable between: i) a non illustrated locking position where tool static brake 32 locks tool actuator 22, and ii) a non illustrated unlocking position where tool static brake 32 unlocks tool actuator 22. Likewise, arm static brake 34 and boom static brake 36 have their respective locking and unlocking positions to lock arm 24 and boom 26.

Besides, the static brakes can include a swing static brake 38 configured to lock swing actuator 28, a blade static brake 39 configured to lock blade actuator 29, a drive static brake 40 configured to lock drive actuators.

Excavator 1 further can include cab 50 configured to accommodate the operator and a command device 52 configured to receive commands from the operator. Command device 52 can for instance comprise a joystick or handle remotely connected to a control unit 54.

The command device 52 is further configured to generate command signals based on said commands. The command signals can be transmitted from command device 52 to control unit 54 either by a wire or wirelessly by radiowaves.

Excavator 1 further includes the control unit 54 configured to receive the command signals from command device 52. Control unit 54 is further configured to control, based on said command signals, the electric actuators 22, 24, 26, 27, 28, 30 and the static brakes 32, 34, 36, 37, 38, 39, 40. Control unit 54 can comprise a memory 56 for storing a dataset containing data identifying each electric actuator 22, 24, 26, 27, 28, 29, 30 belonging to the tool actuating set 20.1 and to the cab actuating set 20.2. Besides, memory 56 can store another dataset containing data identifying each static brake 32, 34, 36, 37, 38, 39, 40 and its respective electric actuator.

Figure 3:
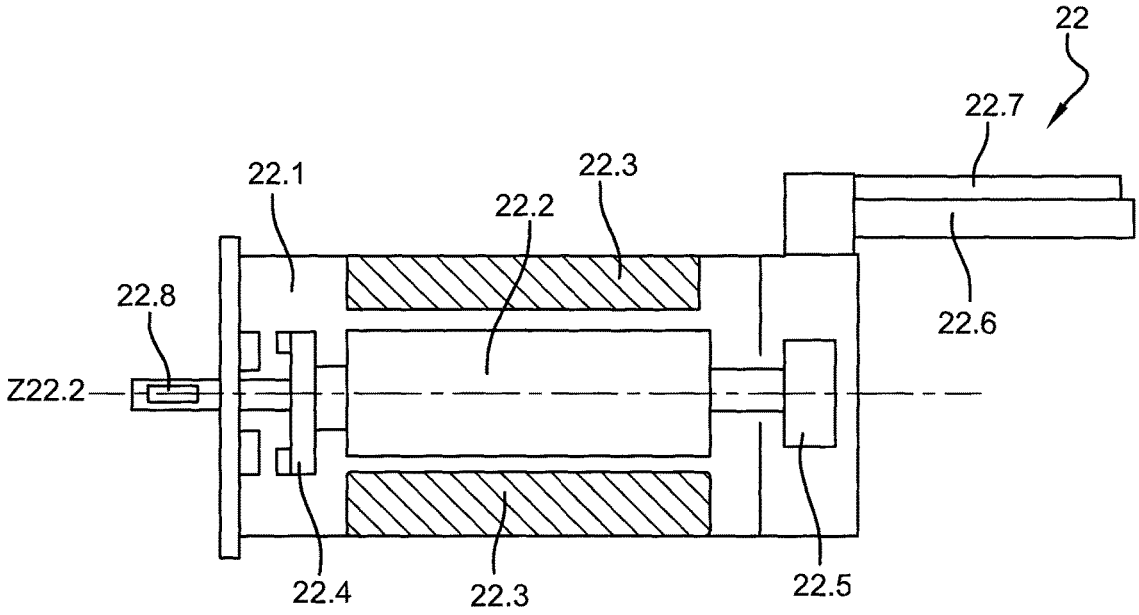
FIG. 3 is a schematic side view of an electric actuator belonging to the excavator of FIG. 1.
Figure 4:
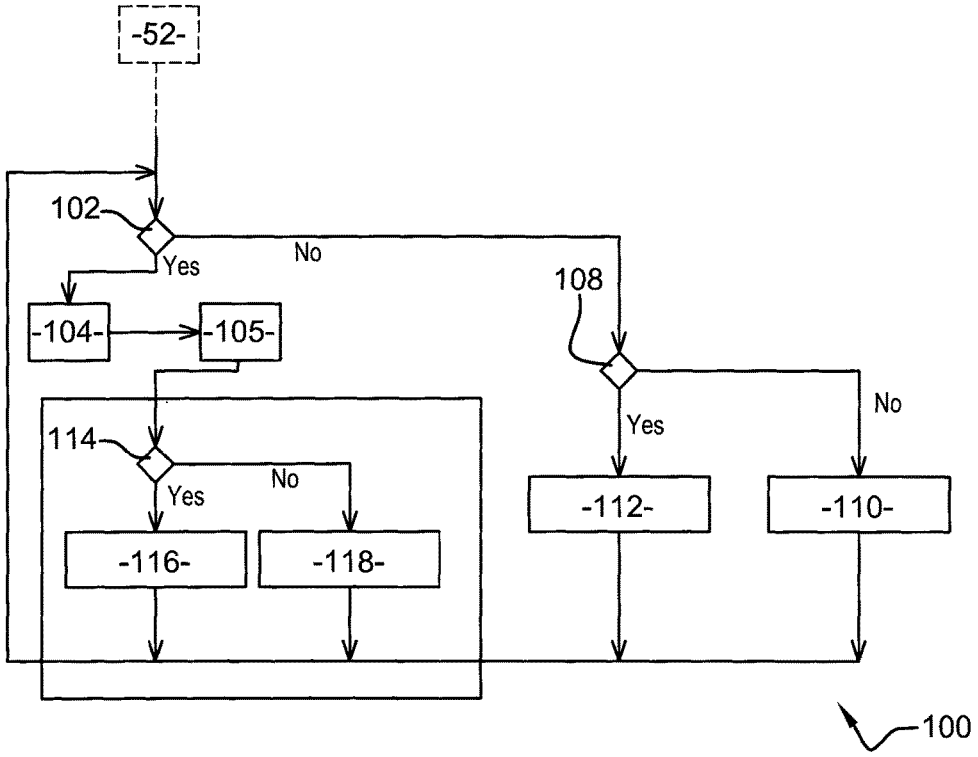
FIG. 4 is a flow chart illustrating a control method according to one aspect of the invention for controlling the excavator of FIG. 1.

FIG. 3 illustrates the tool electric actuator 22. Tool actuator 22 includes a generally cylindrical actuator body 22.1, a rotational electric motor 22.2 with magnetic coils 22.3, a static brake 22.4 and a position sensor 22.5. Position sensor 22.5 can be of the encoder type.

Power supply to the rotational electric motor 22.2 is performed through a power cable 22.6. Rotational electric motor 22.2 rotates around a rotation axis Z22.2.

In service, control unit 54 sends its control signals to tool actuator 22 via a signal cable 22.7. Likewise, position sensor 22.5 sends its feedback signals to control unit 54 via signal cable 22.7.

In service, the output torque of rotational electric motor 22.2 moves a screw rod 22.8. Tool electric actuator 22 actuates the screw rod 22.8 which delivers mechanical power to the tool 2.

Static brake 22.4 has a disk which can rotate with the rotational electric motor 22.2 and which bears braking pads configured to rub against a friction surface attached to actuator body 22.1. Alternatively, a static brake could be located on the electric motor, on a gear or on the screw.

FIG. 2 illustrates a control method 100 according to another aspect of the invention, for controlling excavator 1 when it is in service. Control method 100 includes a reception step 102 wherein control unit 54 receives a command signal. Such a command signal is usually generated by the command device 52 upon command by the operator sitting in cab 50.

In case (Yes) the control unit 54 receives such a command signal, control method 100 performs an actuation check step 104. During actuation check step 104 the control unit 54 checks whether the command signal requires the control unit 54 to actuate at least one electric actuator belonging to an actuating set, say the tool actuating set 20.1 or the cab actuating set 20.2.

The operator sitting in cab 50 can command the tool actuating set 20.1. For instance, the operator may request for a movement using the command device 52, which can include a joystick, a button, a roller, a pedal and/or a lever. The operator's request can be for a position, a speed, a power or a torque. For instance, the operator's request can be for speed. When the command device 52 is at rest the speed request is null, when the command device 52 is displaced the speed request depends on the amplitude of displacement of the command device 52 as from its rest position.

In case (Yes) the command signal requires the control unit 54 to actuate an electric actuator belonging to the tool actuating set 20.1 or to the cab actuating set 20.2, control unit 54 performs an unlocking step 105 where control unit 54 controls tool, arm and boom static brakes 32, 34 and 36 so that tool, arm and boom static brakes 32, 34 and 36 move towards their respective unlocking positions. In other words, the control unit 54 releases all the static brakes 32, 34, 36, 37 or 38, 39, 40 from locking all the electric actuators 22, 24, 26, 27 or 28, 29, 30 which belong respectively to the tool actuating set 20.1 or to the cab actuating set 20.2.

For instance, in case (Yes) the command signal requires the control unit 54 to actuate the tool actuator 22, which belongs to the tool actuating set 20.1, the control unit 54 performs the unlocking step 105 so that tool static brake 32, arm static brake 34 and boom static brake 36 move towards their respective unlocking positions. Thus, control unit 54 releases all the tool, arm and boom static brakes 32, 34 and 36 from locking all the electric actuators 22, 24 and 26 which belong to the tool actuating set 20.1.

When the command signal requires control unit 54 to actuate at least two electric actuators belonging to the tool actuating set 20.1, the control unit 54 can actuate two or three electric actuators belonging to the tool actuating set 20.1. For instance, the command signal may require control unit 54 to actuate the tool actuator 22 and the arm actuator 24 concomitantly when the motion required for the tool 2 has an amplitude which is too large for being reached by the sole tool actuator 22.

Control unit 54 controls tool static brake 32, arm static brake 34 and boom static brake 36 so that tool static brake 32, arm static brake 34 and boom static brake 36 move towards their respective unlocking positions within approximately 50 milliseconds.

During unlocking step 105, control unit 54 can energize the electric motors of all of the electric actuators belonging either to the tool actuating set 20.1 or to the cab actuating set 20.2. For instance, control unit 54 can energize these electric motors before the corresponding static brakes 32, 34, 36, 37, 38, 39 and/or 40 have arrived at their respective unlocking position. Once their electric motors get energized, the electric actuators 22, 24, 26, 28, 29 or 30 can hold the loads in lieu of the static brakes 32, 34, 36, 37, 38, 39 or 40.

Thus, if the command signal or a further command signal requires the control unit 54 to also move the arm 4, then the start of the motion of the arm 4 will not induce backlash, bump nor vibrations through the components of the excavator 1, thus improving the operator's comfort and increasing the service life of the components of the excavator 1.

Otherwise, in case (No) the control unit 54 does not receive a command signal, then the control unit 54 starts a timer 58 plus further, non illustrated timers, which belong to the excavator 1 and which are configured to count several predetermined periods, for instance 10 seconds. Excavator 1 can comprise several timers, for instance at least one timer per actuating set (20.1, 27).

Then control unit 54 performs a timer check step 108:

10) if said predetermined period has not elapsed, then the control unit 54 lies in a waiting state 110 until timer 58 reaches the end of said predetermined period;

12) after said predetermined period has elapsed whereas the control unit 54 has not received any command signal (Yes), the control unit 54 performs a locking step 112 during which the control unit 54 actuates all the static brakes 32, 34, 36, 37, 38, 39, 40 so as to lock all the electric actuators belonging to an actuating set, either the tool actuating set 20.1 or the cab actuating set 20.2.

The control method 100 can further include a lock check step wherein control unit 54 checks whether all the electric actuators 22, 24, 26 or 28, 29, 30 belonging respectively to the tool actuating set 20.1 and/or to the cab actuating set 20.2 are currently locked. In other words, control unit 54 checks whether all the static brakes 32, 34, 36, 37 or 38, 39, 40 are in their respective locking position. In case the lock check step is positive (Yes), control unit 54 can perform the unlocking step 105.

After the unlocking step 105, control unit 54 can perform a motion request check step 114 in order to check: (Yes) whether the motion requested by the operator can be effected by actuating only one electric actuator or instead (No) whether the motion requested by the operator requires the actuation of more than one electric actuator of the actuating set, e.g. the tool actuating set 20.1.

In case (Yes) the motion requested by the operator involves only one electric actuator, in a steady step 116, control unit 54 keeps actuating the first electric actuator already moving, without actuating a second electric actuator.

In case (No) the motion requested by the operator involves two or more electric actuators, in an actuation step 118, control unit 54 can actuate a second electric actuator belonging to the same actuating set as the first electric actuator already moving. The second electric actuator is actuated in proportion of the requested motion. Thus, the second electric actuator and the first electric actuator move concomitantly or consecutively to move a part of the excavator 1.

For instance, in case (No) the motion requested by the operator involves tool actuator 22 and arm actuator 24, whereas only tool actuator 22 is moving, control unit 54 can, in the actuation step 118, actuate arm actuator 24 concomitantly to tool actuator 22 so as to move tool 2.

Furthermore, excavator 1 can further include several position sensors. Each position sensor can be configured to detect the position of a respective electric actuator and to send position signals to control unit 54. Control unit 54 can be further configured to determine the position of each one of the electric actuators based upon said position signals. For instance, each position sensor can be an encoder coupled with a respective electric actuator.

The control method 1 can be performed continuously or recursively as long as the excavator 1 is in service. In other words, control method 1 can be performed as a loop.

It is to be understood that the present invention is not limited to the embodiments described above and illustrated in the appended drawings. Instead, the skilled person will recognize that many changes and modifications may be made within the scope of the appended claims.

For instance, according to a non illustrated embodiment, the excavator can include an actuating set comprising an hydraulic actuator and several electric actuators. The control method can be implemented on such an excavator.

Likewise, according to a non illustrated embodiment, in addition to one or several actuating set(s) comprising only electric actuators (no hydraulic actuators) as here-above mentioned, the excavator can comprise one or several hydraulic actuators, controlled individually apart from the electric actuators. The control method can be implemented on such an excavator.

The invention claimed is:

1. A control method, for controlling an excavator, the control method including a step of:

providing an excavator including at least:

several movable members, each movable member being configured to move at least a part of the excavator, at least one actuating set comprising at least two actuators, the at least two actuators including at least one electric actuator, each actuator being configured to actuate at least one of the movable members, at least one static brake movable between: i) a locking position where the at least one static brake locks the at least one electric actuator, and ii) an unlocking position where the at least one static brake unlocks the at least one electric actuator, a command device configured to receive commands from an operator and to generate command signals based on the commands, a control unit configured to receive the command signals and to control the actuators and the at least one static brake based on the command signals, the control method further including at least:

a reception step wherein the control unit receives a command signal, an actuation check step wherein the control unit checks whether the command signal requires the control unit to actuate at least one actuator belonging to the at least one actuating set, and an unlocking step, after the command signal requires the control unit to actuate an actuator belonging to the at least one actuating set, wherein the control unit controls the at least one static brake so that the at least one static brake moves towards its unlocking position.

2. The control method according to claim 1, wherein the control unit controls the at least one static brake so that the at least one static brake moves towards its unlocking position within less than 500 millisecond.

3. The control method according to claim 1, wherein the at least one actuating set comprises at least two electric actuators, wherein the excavator includes at least two static brakes, each static brake being movable between: i) a respective locking position where the static brake locks a respective electric actuator, and ii) a respective unlocking position where the static brake unlocks the respective electric actuator, and wherein, during the unlocking step, the control unit controls each static brake so that each static brake moves towards its respective unlocking position.

4. The control method according to claim 3, wherein the at least two electric actuators each includes a respective electric motor, and wherein, during the unlocking step, the control unit energizes:

at least one electric motor so as to actuate at least one of the electric actuators, and the remaining electric motors of all of the electric actuators belonging to the at least one actuating set in order to maintain in a static position the electric actuators.

5. The control method according to claim 4, wherein, during the unlocking step, the control unit energizes all the electric motors so as to actuate all of the electric actuators belonging to the at least one actuating set.

6. The control method according to claim 1, wherein the actuators belonging to the at least one actuating set are configured to cooperate in order to generate a combined motion of at least one of the movable members.

7. The control method according to claim 6, further including an actuation step wherein the control unit actuates at least two actuators belonging to the at least one actuating set when the command signal requires the control unit to actuate the at least two actuators belonging to the at least one actuating set.

8. The control method according to claim 1, wherein the at least one electric actuator is selected in the group consisting of a linear electric actuator and a rotational electric actuator.

9. The control method according to claim 1, wherein the at least one electric actuator includes a respective electric motor, and wherein, during the unlocking step, the control unit energizes the electric motor.

10. The control method according to claim 9, wherein, during the unlocking step, the control unit energizes the electric motor of the at least one electric actuator before the at least one static brake moves towards its respective unlocking position.

11. The control method according to claim 9, wherein, during the unlocking step, the control unit energizes the electric motor of the electric actuator substantially during a period where the at least one static brake moves towards its respective unlocking position.

12. The control method according to claim 11, wherein, during the unlocking step, the control unit energizes the electric motor of the at least one electric actuator progressively as the at least one static brake moves towards its respective unlocking position.

13. The control method according to claim 9, wherein, during the unlocking step, the control unit energizes the electric motor so as to actuate the at least one electric actuator belonging to the at least one actuating set.

14. The control method according to claim 9, wherein, during the unlocking step, the control unit energizes the at least one electric motor so as to maintain in a static position the at least one electric actuator.

15. The control method according to claim 1, wherein the control unit comprises a memory for storing at least a dataset containing data identifying each actuator belonging to the at least one actuating set.

16. The control method according to claim 1, further comprising a cab, wherein each one of the movable members is selected from the group consisting of a tool configured to work on a site, an arm configured to move the tool, a boom configured to move the arm, an offset member configured to offset the boom, a drive member configured to displace the cab with respect to a site ground and a blade configured to partially lift the cab.

17. The control method according to claim 16, wherein the movable members include a tool configured to work on a site and an arm configured to move the tool, wherein the at least one actuating set comprises a tool actuating set, the tool actuating set including at least a tool actuator configured to drive the tool and an arm actuator configured to drive the arm, and wherein the at least one static brake includes at least a tool static brake configured to lock the tool actuator and an arm static brake configured to lock the arm actuator.

18. The control method according to claim 17, wherein the movable members further include a boom configured to move the arm, wherein the tool actuating set further includes a boom actuator configured to drive the boom, and wherein the static brakes further include a boom static brake configured to lock the boom actuator.

19. The control method according to claim 18, wherein the movable members further include an offset member configured to offset the boom, and wherein the tool actuating set further includes an offset actuator configured to drive the offset member, and wherein the static brakes further include an offset static brake configured to lock the offset actuator.

20. The control method according to claim 1, further comprising a cab, wherein the movable members further include a blade configured to partially lift the cab and a drive member configured to displace the cab, wherein the at least one actuating set comprises a cab actuating set, the cab actuating set including at least a blade actuator configured to drive the blade and a drive actuator configured to drive the drive member, and wherein the at least one static brake includes at least a blade static brake configured to lock the blade actuator and a drive static brake configured to lock the drive member.

21. The control method according to claim 20, wherein the drive member comprises at least two drive devices including a right track drive device configured to impart a translation to a right part of the excavator and a left track drive device configured to impart a translation to a left part of the excavator, and wherein the cab actuating set is configured to actuate both the right track drive device and the left track drive device.

22. The control method according to claim 20, wherein the movable members further include a swing member configured to swing the cab, wherein the cab actuating set further includes at least a swing actuator configured to drive the swing member, and wherein the static brakes include at least a swing static brake configured to lock the swing actuator.

23. The control method according to claim 1, further including a lock check step wherein the control unit checks whether the at least one electric actuator is currently locked, wherein the control unit performs the unlocking step in case the at least one electric actuator is currently locked.

24. The control method according to claim 1, wherein the excavator further includes several position sensors, each position sensor being configured to detect the position of a respective electric actuator and to send position signals to the control unit, the control unit being further configured to determine the position of each one of the electric actuators based upon the position signals.

25. The control method according to claim 24, wherein each position sensor is an encoder coupled with an electric actuator.

26. The control method according to claim 1, wherein the control unit further comprises at least one timer (58) for counting at least one predetermined period as from the start of the reception step, and wherein, after the predetermined period has elapsed without the control unit receiving any further command signal, the control unit controls the at least one static brake so as to move the at least one static brake towards its respective locking position.

27. The control method according to claim 1, wherein the excavator further comprises at least one temperature sensor configured to measure the temperature of the at least one electric actuator and connected to the control unit, the control method further including a cooling step wherein, in case the temperature exceeds a predetermined temperature threshold, the control unit controls the at least one static brake so as to move the at least one static brake towards its respective locking position.

28. The control method according to claim 1, wherein the at least one electric actuator includes a respective electric motor, and wherein, during the locking step, the static brake prevents rotation of the electric motor.

29. An excavator including at least:

several movable members, each movable member being configured to move at least a part of the excavator, at least one actuating set comprising at least two actuators, the at least two actuators including at least one electric actuator configured to actuate at least one of the movable members, at least one static brake movable between: i) a locking position where the at least one static brake locks the at least one electric actuator, and ii) an unlocking position where the at least one static brake unlocks the at least one electric actuator, a command device configured to receive commands from an operator and to generate command signals based on the commands, a control unit configured to receive the command signals and to control the actuators and the at least one static brake based on the command signals, the control unit being further configured to perform at least:

a reception step wherein the control unit receives a command signal, an actuation check step wherein the control unit checks whether the command signal requires the control unit to actuate an actuator belonging to the at least one actuating set, and an unlocking step, after the command signal requires the control unit to actuate an electric actuator belonging to the at least one actuating set, wherein the control unit controls the at least one static brake so that the at least one static brake moves towards its unlocking position.

30. The excavator according to claim 29, wherein the at least one electric actuator includes a respective electric motor, and wherein, during the locking step, the static brake prevents rotation of the electric motor.

* * * * *